United States Patent [19]

Faria et al.

[11] 4,388,394

[45] Jun. 14, 1983

[54] CADMIUM SULFIDE PHOTOCONDUCTOR BLENDED WITH LIGHT-ABSORBING MATERIAL

[75] Inventors: Sixdeniel Faria; Ronald E. Karam, both of Towanda, Pa.

[73] Assignee: Gte Products Corporation, Stamford, Conn.

[21] Appl. No.: 282,785

[22] Filed: Jul. 13, 1981

[51] Int. Cl.[3] ..... G03G 5/04

[52] U.S. Cl. ..... 430/94; 430/56; 430/69; 430/95

[58] Field of Search ..... 430/94, 89, 56, 95, 430/69

[56] References Cited

U.S. PATENT DOCUMENTS

| | | | |
|---|---|---|---|
| 3,510,299 | 5/1970 | Herrick et al. | 430/89 |
| 3,867,139 | 2/1975 | Yamada et al. | 430/94 |
| 4,239,844 | 12/1980 | Faria et al. | 430/94 |

*Primary Examiner*—Bernard D. Pianalto

*Attorney, Agent, or Firm*—J. Theodosopoulos

[57] ABSTRACT

A photoreceptor device comprises a conductive substrate and an electrophotographic layer thereon. The electrophotographic layer comprises copper-chlorine activated cadmium sulfide blended with a light-absorbing material.

5 Claims, 1 Drawing Figure

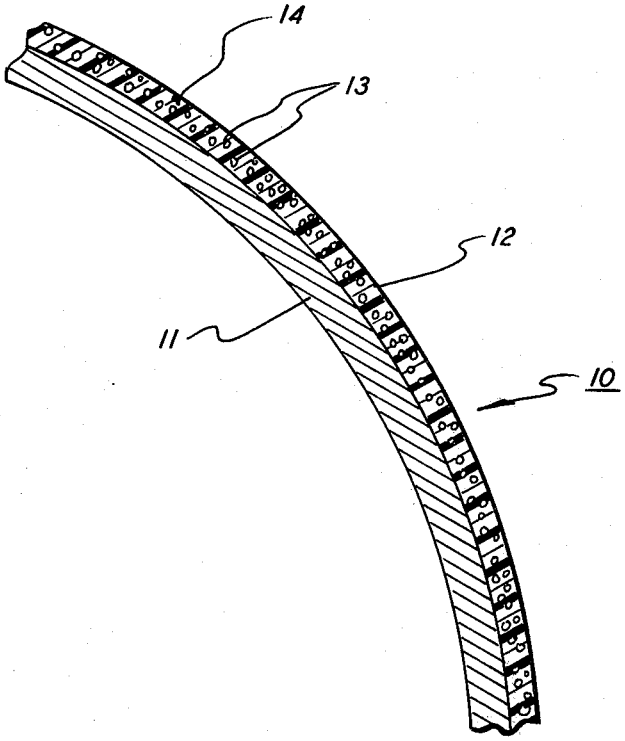
14
13
12
11
10

CADMIUM SULFIDE PHOTOCONDUCTOR BLENDED WITH LIGHT-ABSORBING MATERIAL

This invention concerns copper-chlorine activated cadmium sulfide (CdS:Cu:Cl) photoconductors. Examples of such photoconductors are shown in U.S. Pat. Nos. 2,995,474 and 3,694,201. The invention is particularly concerned with improved copper-chlorine activated cadmium sulfide photoconductors, such as disclosed in copending application Ser. No. 233,806 filed Feb. 12, 1981, a continuation in part of Ser. No. 128,330 filed Mar. 7, 1980, now abandoned, and of Ser. No. 147,902 filed May 8, 1980, now abandoned, same assignee as instant application, having faster speed (higher photodischarge rate) than some previous photoconductors generally available. Copiers using high speed photoconductors can operate with lower intensity light sources and are capable of higher copying speeds than copiers using slower photoconductors.

However, there are some applications where the speed of CdS:Cu Cl photoconductor is too fast, for example, in copiers using a high intensity exposure lamp. In such applications, the light reflected from the unprinted portions of the original will completely discharge those portions of the photoreceptor which are illuminated by this reflected light. In addition, the light reflected from the printed portions of the original can be of sufficiently high intensity to significantly discharge those portions of the photoreceptor which receive this light. The result is low contrast potential and poor image quality. In these applications, it is necessary to reduce the photodischarge rate of the photoconductor.

In this invention the photodischarge rate of a CdS:Cu:Cl photoconductor is reduced by blending it with a light-absorbing material.

BRIEF DESCRIPTION OF THE FIGURE

The drawing is a sectional view of a photoreceptor device incorporating a blend of CdS:Cu:Cl photoconductor and a light-absorbing material in accordance with this invention.

DETAILED DESCRIPTION OF THE FIGURE

A photoconductor may be incorporated into a photoreceptor device by mixing the photoconductor with an organic binder which has been dissolved in a suitable solvent. The mixture is then coated onto a conductive substrate such as an aluminum drum. The drawing shows a portion of a drum 10 sectioned to illustrate a conductive substrate 11 and a photoconductive layer 12. Photoconductive layer 12 comprises particles 13 of CdS:Cu:Cl dispersed in a resin binder matrix 14. A light-absorbing material is also dispersed in matrix 14.

In one example, the following ingredients were blended together: 98 grams of Type PC-108 CdS:Cu:Cl photoconductor powder; 4.1 grams of Ferro Corp. V-302 black pigment; 28.4 grams of Thermoset Plastics Inc. liquid epoxy resin binder E-600; 18 grams of Thermoset Plastics Inc. Hardener 65; 25.1 grams of methyl isobutyl ketone; 21 grams of tetrahydrofuran; 4 grams of Shell Chemical Co. aromatic solvent SC-100. After thorough blending, the blended suspension was screened through a 500 mesh screen and then sprayed on 3 mil thick aluminum substrate 11. Similar formulations were made with higher concentrations of black pigment.

Aluminum substrates 11 coated with the above formulations were evaluated in a Royal Brand RBC-1 copier having a high intensity light source. Samples containing various amounts of black pigment were measured at almost equivalent charging voltage, while maintaining the photoconductor to binder ratio constant at 2.2 to 1.0. The results are shown in Table I.

TABLE 1

| % Black Pigment | Charge Acceptance, Volts/Micrometer | Photodischarge Rate, Volts/Sec.-Micrometer |
|---|---|---|
| 0 | 26.52 | 42.93 |
| 4 | 22.36 | 18.48 |
| 8 | 21.42 | 16.85 |
| 16 | 19.0 | 6.84 |

At a setting of one (maximum light intensity) in the RBC-1, copies made from the 4% black pigment formulation looked reasonably good. Copies made from the formulations containing more than 4% black pigment had background discoloration, indicating that too much light was being absorbed by photoconductive layer 12.

It can be seen from Table I that the use of 4% black pigment had a marked effect on the photodischarge rate, reducing it from 42.93 to 18.48 volts per second per micrometer. It is expected that the use of more than 16% black pigment is unlikely, since most copiers require a photoconductor having a photodischarge rate greater than 6.84 volts per second per micrometer.

The V-302 black pigment is composed of copper, manganese, chromium and molybdenum in compound form. Other light-absorbing materials that could be used include copper activated cadmium selenide, manganese activated yttrium oxide, or a black organic dye dispersed or dissolved in the binder. Other colored pigments (blue, yellow, red, etc.) could be used in a similar manner to absorb selective wavelengths of the incident light, thereby altering the apparent spectral sensitivity of the photoconductor.

We claim:

1. A photoreceptor device comprising a conductive substrate and an electrophotographic layer thereon, the electrophotographic layer comprising particles of copper-chlorine activated cadmium sulfide photoconductor dispersed in a resin binder matrix, a light-absorbing material also being dispersed in said resin binder matrix, the amount of light-absorbing material being sufficient to significantly reduce the photodischarge rate of the electrophotographic layer.

2. The photoreceptor device of claim 1 wherein the light-absorbing material is a black pigment.

3. The photoreceptor device of claim 2 wherein the amount of black pigment is up to about 16% of the total of black pigment plus photoconductor.

4. The photoreceptor device of claim 1 wherein the light absorbing material is a black organic dye.

5. A photoconductor device comprising a conductive substrate an an electrophotographic layer thereon, the electrophotographic layer comprising particles of copper-chlorine activated cadmium sulfide photoconductordispersed in a resin binder matrix, a light-absorbing material also being dispersed in said resin binder matrix, the light-absorbing material being predetermined to absorb selective wavelengths of light, thereby altering the apparent spectral sensitivity of the photoconductor.

* * * * *

UNITED STATES PATENT AND TRADEMARK OFFICE

CERTIFICATE OF CORRECTION

PATENT NO. : 4,388,394

DATED : June 14, 1983

INVENTOR(S) : Sixdeniel Faria & Ronald E. Karam

It is certified that error appears in the above-identified patent and that said Letters Patent are hereby corrected as shown below:

On the title page:

The assignee for the subject patent should be -- GTE Products Corporation --.

Signed and Sealed this

*Twenty-third* Day of *August 1983*

[SEAL]

*Attest:*

GERALD J. MOSSINGHOFF

*Attesting Officer*

*Commissioner of Patents and Trademarks*